United States Patent [19]

Vinson

[11] 4,262,900

[45] Apr. 21, 1981

[54] PLAYGROUND SET

[76] Inventor: James D. Vinson, 3626 West End Ave., Nashville, Tenn. 37205

[21] Appl. No.: 813,827

[22] Filed: Jul. 8, 1977

[51] Int. Cl.[3] ..... A63B 9/00; A63B 1/00; A63B 17/00

[52] U.S. Cl. ..... 272/113; 272/54; 272/56.5 R; 272/63; 272/85

[58] Field of Search ..... 272/113, 112, 56.5 R, 272/54, 63, 85; 273/1.5

[56] References Cited

U.S. PATENT DOCUMENTS

| | | | |
|---|---|---|---|
| 1,765,361 | 6/1930 | Berman | 272/113 |
| 1,901,964 | 3/1933 | Haskell | 272/113 |
| 2,929,627 | 3/1960 | Scanlon | 272/113 X |
| 2,977,118 | 3/1961 | Farkas | 273/1.5 R X |
| 3,141,670 | 7/1964 | Smyrni et al. | 272/113 X |
| 3,539,181 | 11/1970 | Larsen | 272/56.5 R |
| 3,601,397 | 8/1971 | Carlin | 272/56.5 R |

OTHER PUBLICATIONS

"Gym-Dandy"-Playthings Magazine, vol. 62, No. 1, p. 17, 1964, Jan.

*Primary Examiner*—William R. Browne
*Attorney, Agent, or Firm*—Abe Hatcher

[57] ABSTRACT

An elevated house hereinafter called a treehouse in combination with at least one of the following additional items: one or more swings such as a swingset, a set of gymnastic bars, a see-saw or teeter-totter, parallel bars for swinging and walking with one's arms, a slide, a basket and backboard for playing basketball, a firemen's pole, a ladder adapted for climbing up into said house, a trapdoor adapted for entrance into said house and a platform adapted for beginning a slide down said firemen's pole.

3 Claims, 5 Drawing Figures

PLAYGROUND SET

BACKGROUND OF THE INVENTION

1. Field of the Invention

This invention relates to recreational devices. More particularly, it relates to a play set adapted for use in school playgrounds, back yards and the like.

2. Description of the Prior Art

Swing sets for playground and backyard use are known, including those having slides and arm swings for small children. Also known are treehouses, firemen's poles such as firemen slide down when rushing to get their fire engines, and gym sets, including various kinds of exercise bars and parallel, hand-swinging, or walking bars. However, to date no one has provided a unit containing more than one of the aforesaid recreational items adapted to be used at a single location within confined quarters.

SUMMARY OF THE INVENTION

In its broader aspects my invention involves a playground set made up of a swing set comprising, for example, a plurality of swings, placed at varying heights for varying ages, and including one with arms for small children, a slide and a seesaw or teeter-totter, plus a treehouse that stands on its own and is not associated with a tree, that is, a second story or upstairs playhouse supported on a stilt-like or rod framework. My playground set also preferably contains at least one of the following items, viz., a gym set, parallel bars for arm walking, a ladder leading to the main floor of the treehouse, a firemen's pole, a platform from which one can slide down the firemen's pole, a trap door for entrance to the treehouse at a main floor or second-story level, a ring or basket with backboard for playing basketball. The complete set of the invention with all parts thereof fastened together fits within an area not greater than about 400 square feet.

DESCRIPTION OF THE DRAWING AND OF A PREFERRED EMBODIMENT

For a better understanding of the drawing, reference will now be made to the drawing hereof, which represents a preferred embodiment of the invention and in which, FIG. 1 is a perspective view at an angle from the ladder side of the playhouse set of the invention.

Figure 1:
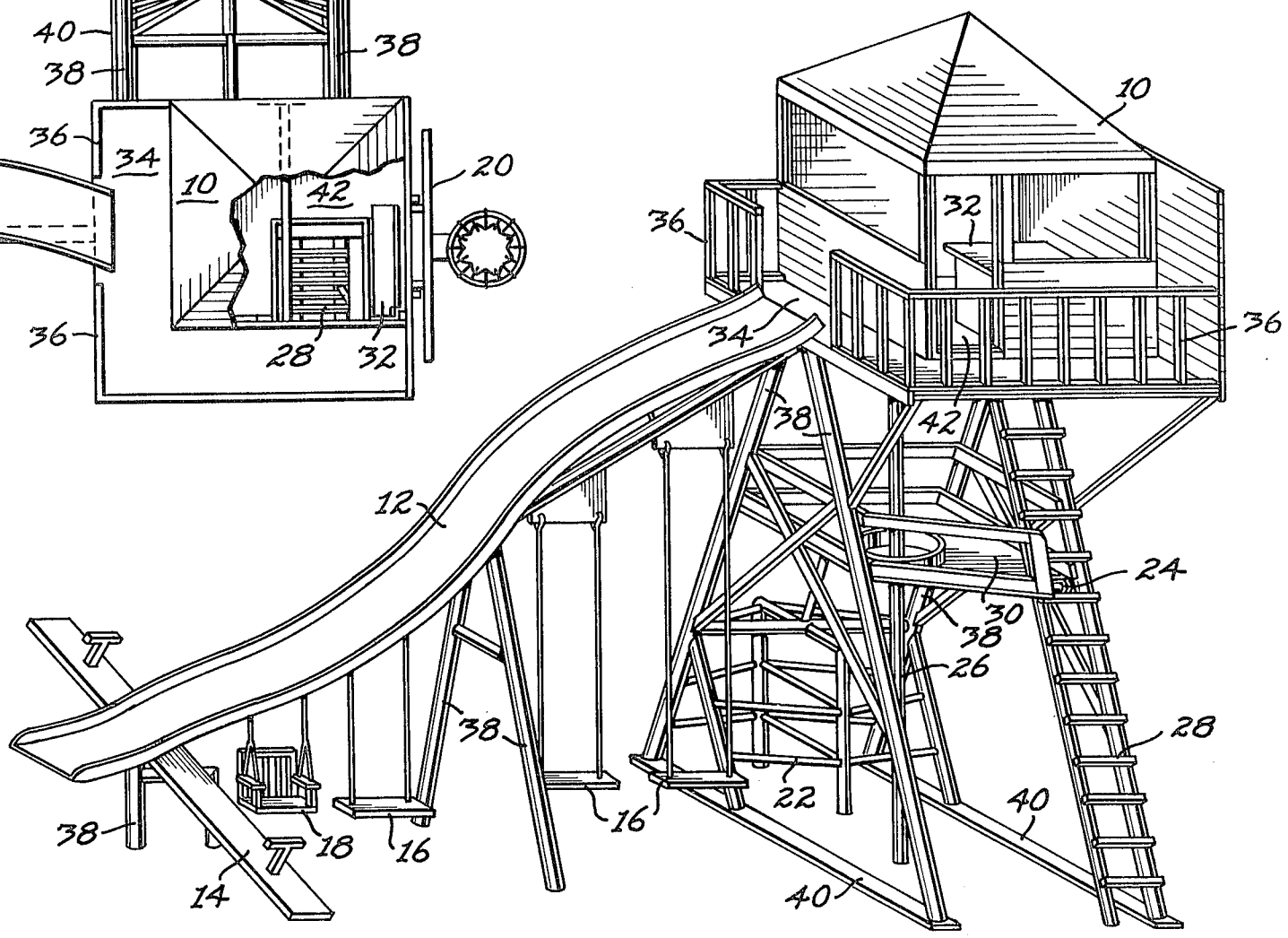
Figure 2:
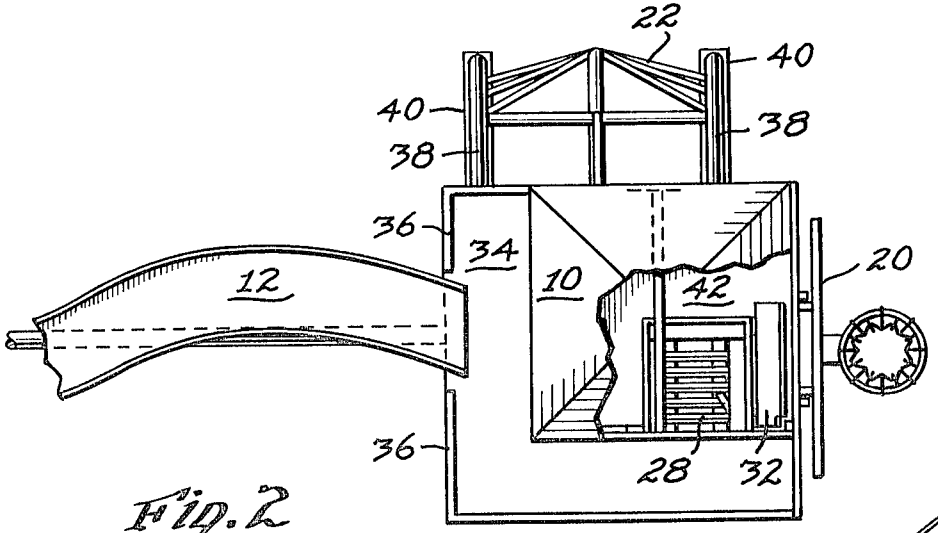
FIG. 2 is a perspective view from above, mainly of the treehouse portion of the playground set of the invention, with part of the roof broken away to show open trap door and items therebeneath.
Figure 5:
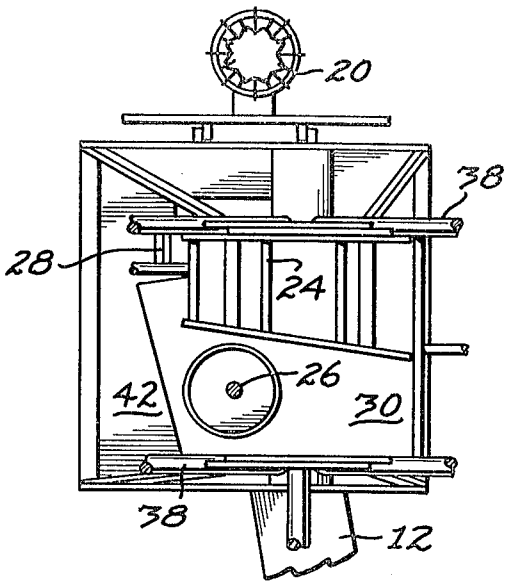
FIG. 5 is a sectional perspective view, mainly of the treehouse portion of the playground set of the invention looking upward from A—A of FIG. 4.
Figure 3:
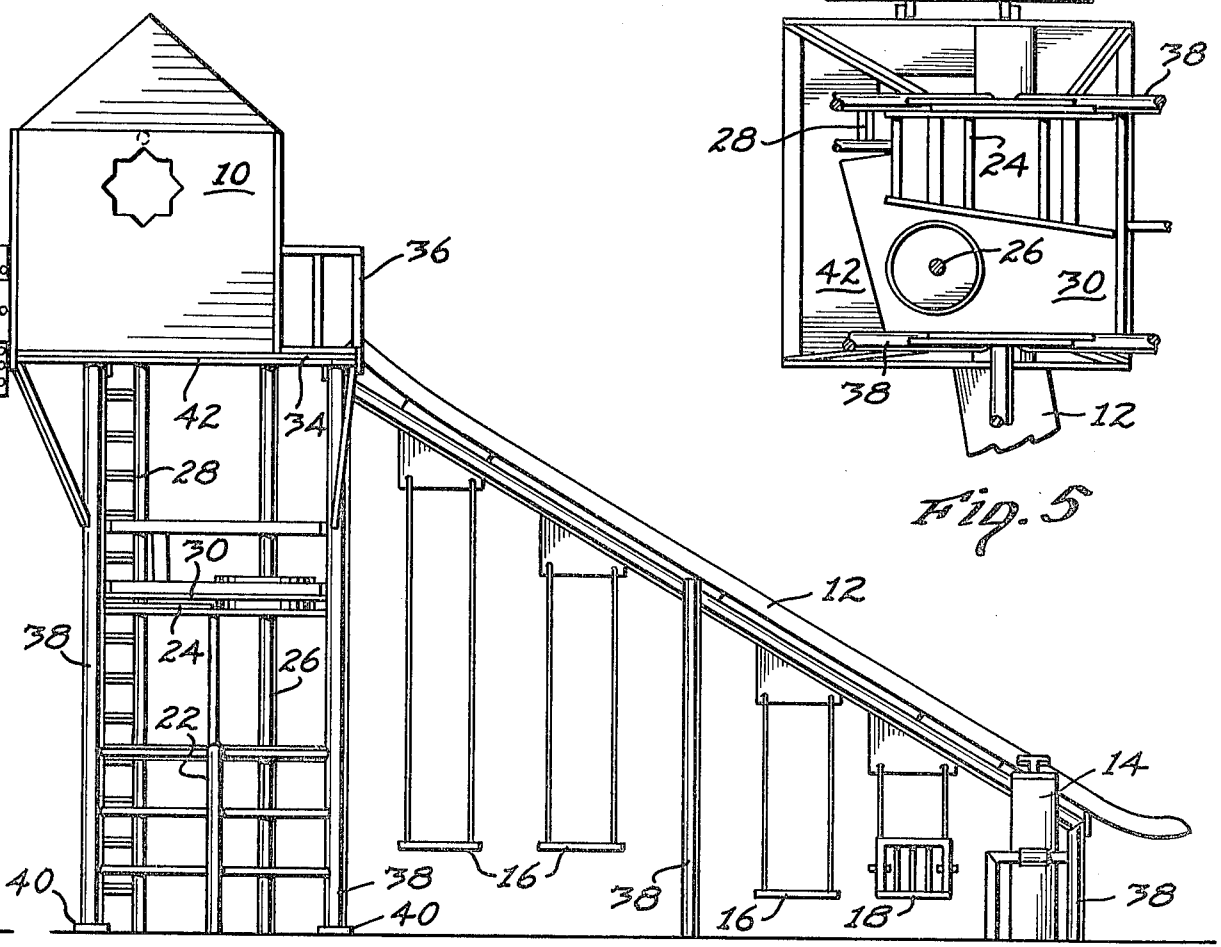
FIG. 3 is a perspective view from the basketball-playing side or end of the playground set of the invention.
Figure 4:
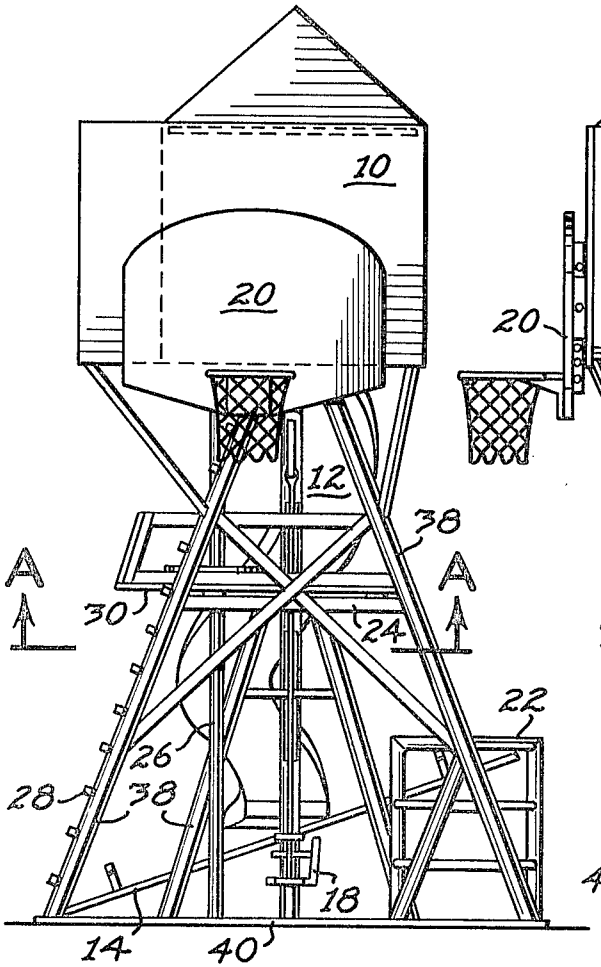
FIG. 4 is a perspective view showing the playground set of the invention from the gym set side.

In the drawing, the playground set is shown made up of a treehouse 10 which may be of wood, plastic, metal or the like, an associated swingset which may be made principally of steel, aluminum or alloy comprising a slide 12, teeter-totter or seesaw 14, swings 16 and a chair swing 18, a basektball playing device 20, including backboard and basket, a gym set 22 with bars for all sorts of body exercises, monkey bars 24 for walking with one's arms, a fire pole 26 for sliding down, a ladder 28 for climbing up into treehouse 10 and off onto platform 30, if one desires, a trap door 32 whereby entrance to the treehouse may be obtained, a balcony 34 with its rails 36, from which balcony one may slide down slide 12, A-type or like supports 38, which are preferably of the usual steel, aluminum or alloy tubular construction, optional bottom supports 40, as the A-type or like supports 38 may be anchored in the ground or in concrete, if desired, and treehouse floor 42.

While the invention has been described in terms of preferred embodiments, the claims appended hereto are intended to encompass all embodiments which fall within the spirit of the invention.

Having thus described my invention and certain preferred embodiments thereof, I claim:

1. A playground set comprising joined as a unitary structure adapted to fit together within an area not greater than about 400 square feet, a treehouse which has a balcony and rails and as associated swingset which includes a plurality of swings placed at various heights above the ground, a seesaw and a slide, said swings being positioned below said slide.

2. A playground set comprising joined as a unitary structure adapted to fit together within an area not greater than about 400 square feet, a treehouse which as a balcony and rails and an associated swingset which includes a plurality of swings placed at various heights above the ground, a seesaw and a slide, said swings being positioned below said slide and including a child's arm swing positioned away from said slide.

3. A playground set comprising joined together as a unitary structure adapted to fit together within an area not greater than about 400 square feet, a treehouse, an associated swingset, a platform adapted to fit below a floor of said treehouse and in association with said platform a firemen's pole adapted for sliding down from said platform and parallel bars for hand-walking fitting beneath said platform substantially parallel to ground level.

* * * * *